United States Patent [19]

Cox

[11] Patent Number: 4,610,111

[45] Date of Patent: Sep. 9, 1986

[54] ECCENTRICALLY ADJUSTABLE ATTACHMENTS FOR POWER TOOLS

[75] Inventor: Alan W. Cox, Cockfield, England

[73] Assignee: Black & Decker Inc., Newark, Del.

[21] Appl. No.: 712,623

[22] Filed: Mar. 18, 1985

[30] Foreign Application Priority Data

Mar. 19, 1984 [GB] United Kingdom ..... 8407058

[51] Int. Cl.[4] ..... B24B 23/02

[52] U.S. Cl. ..... 51/170 MT; 51/168; 409/232; 83/699; 279/6

[58] Field of Search ..... 51/170 R, 170 MT, 168; 409/231, 232, 234; 83/666, 698, 699; 279/6, 9 A

[56] References Cited

U.S. PATENT DOCUMENTS

| | | | |
|---|---|---|---|
| 2,706,875 | 4/1955 | Higley . | |
| 2,794,303 | 6/1957 | Wickes . | |
| 3,084,364 | 4/1963 | Hutchins . | |
| 3,199,251 | 8/1965 | Enders . | |
| 3,482,362 | 12/1969 | Bangerter | 51/170 R |

FOREIGN PATENT DOCUMENTS

| | | | |
|---|---|---|---|
| 2700241 | 7/1978 | Fed. Rep. of Germany | 51/170 MT |
| 2745129 | 4/1979 | Fed. Rep. of Germany | 51/170 MT |
| 1508906 | 11/1967 | France . | |
| 250138 | 6/1948 | Switzerland . | |
| 2931 | of 1885 | United Kingdom | 279/6 |
| 303172 | 2/1970 | U.S.S.R. | 51/168 |

OTHER PUBLICATIONS

European Search Report 6-13-85.

*Primary Examiner*—Roscoe V. Parker
*Attorney, Agent, or Firm*—Edward D. Murphy; Harold Weinstein; Edward D. C. Bartlett

[57] ABSTRACT

A surface treatment attachment for a power tool, for example a sanding attachment for a hand-held power drill, has a body which can be secured to the power tool to be rotated thereby and which is arranged to receive a treatment head (e.g. a sanding disc). With a view to enabling a consistently improved performance to be achieved under a variety of conditions, structure is provided for selecting the degree of eccentricity of the treatment head relative to axis of rotation of the body of the attachment. The degree of eccentricity may be continuously adjustable within pre-set limits and, advantageously, the attachment includes an arrangement for accommodating a tilting movement of the treatment head.

12 Claims, 9 Drawing Figures

ECCENTRICALLY ADJUSTABLE ATTACHMENTS FOR POWER TOOLS

BACKGROUND OF THE INVENTION

1. Field of the invention

This invention relates to attachments for power tools and has particular reference to a surface treatment attachment for a hand-held power tool. Such attachments are used to abrade surfaces and/or to impart a desired surface finish as required.

2. Brief description of the prior art

A simple form of surface treatment attachment comprises merely a disc carrying an axially orientated spindle. The attachment is rotated by a hand-held electric drill via the spindle which is secured in the chuck of the drill. The disc supports an abrasive surface for example a sand or emery paper which, when held in contact with a surface, will abrade the latter.

It has been found that an improved effect is obtained if the disc is given an orbital motion and this can be achieved by means of a construction in which the disc is so mounted as to be capable of rotation about an axis parallel to but spaced from the axis of rotation of the chuck. Whilst this construction provides a general improvement, it is found that the level of improvement is lower in some cases than others. It is an object of the present invention to enable a more consistent level of improvement to be achieved.

SUMMARY OF THE INVENTION

According to the present invention, a surface treatment attachment for a power tool comprises a body securable to the power tool for rotation thereby and arranged to receive a treatment head, and means for selecting the degree of eccentricity of the treatment head relative to the axis of rotation of the body.

The body may comprise a body portion which is securable to the power tool and an eccentric which is rotatable with the body portion and is arranged to receive the treatment head. The eccentric may be adjustable relative to the body portion for selection of the degree of eccentricity of the treatment head. More particularly, the eccentric may be rotatable relative to the body portion to select the degree of eccentricity of the treatment head. In embodiments of the invention described herein, the eccentric is mounted in a recess in the body portion. The recess may be generally cylindrical, the axis of the cylinder being offset from the axis of rotation of the body portion.

In one embodiment, the eccentric has a plurality of pre-set rotational positions relative to the body portion, the attachment including means for securing the eccentric in a selected one of those positions.

In another embodiment, the rotational position of the eccentric relative to the body portion is continuously adjustable within pre-set limits, the attachment including means for securing the eccentric in the selected position.

Advantageously, the body includes means for accommodating a tilting movement of the head.

DESCRIPTION OF THE DRAWINGS

By way of example only, embodiments of the invention will now be described in greater detail with reference to the accompanying drawings of which.

DETAILED DESCRIPTION OF THE PREFERRED EMBODIMENTS OF THE INVENTION

Figure 9:
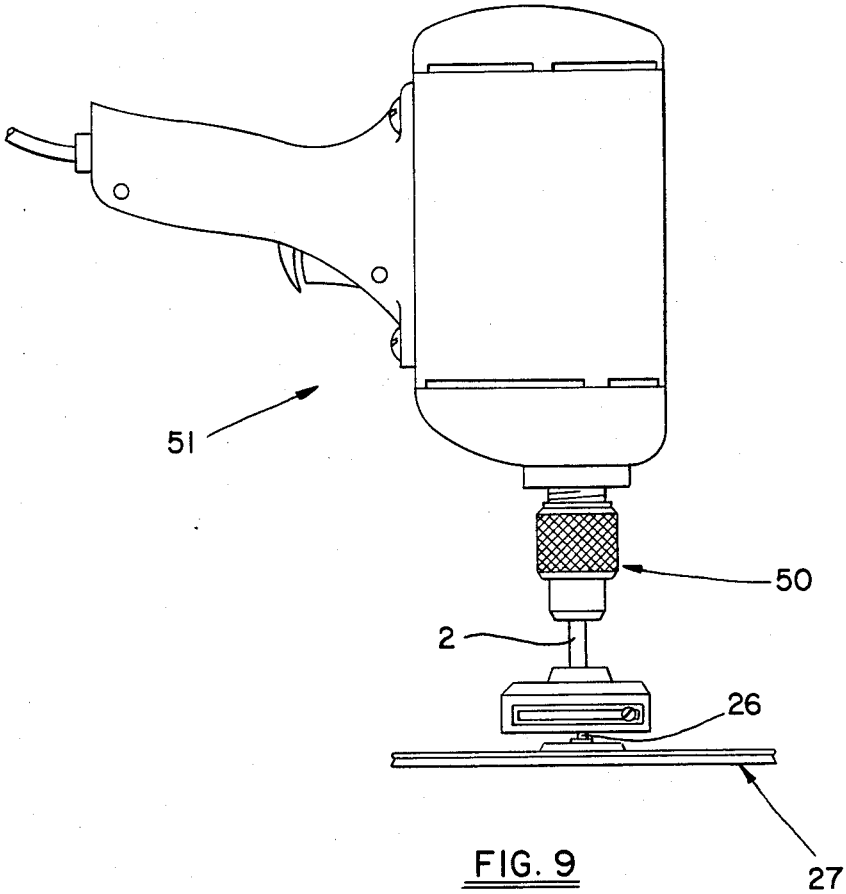
FIG. 9 shows a power tool with an attachment in accordance with the invention.

The embodiment shown in FIGS. 1–5 is an attachment for a hand-held power drill and comprises a hollow body portion 1 of substantially cylindrical external form with an integral spindle 2 lying on the longitudinal axis 3 of the cylinder. For use, the spindle 2 is inserted into the chuck of the power drill, as illustrated in FIG. 9 and described below.

The body portion 1 is configured internally to provide an internal circular recess 4 (FIG. 3) that is eccentric with respect to the axis 3. The curved wall of the recess is slotted as at 5, the slot extending over 180° of arc, the wall being stepped as at 5*a* round the periphery of the slot.

Figure 3:
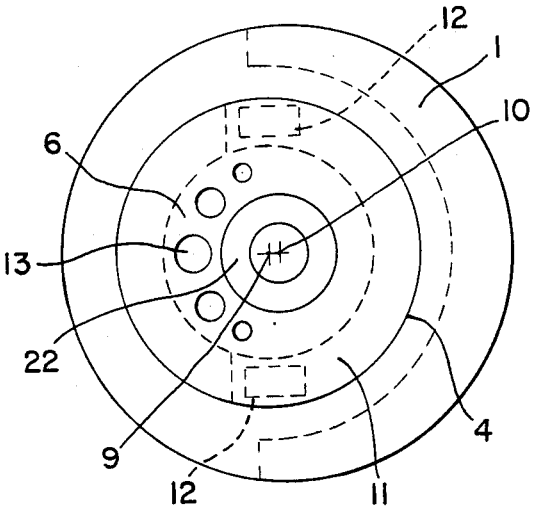
FIG. 3 is a view from underneath of the first embodiment with parts removed.

The recess 4 accommodates an eccentric 6 (FIG. 2) with a disc-like base 7, and a boss 8 with a bore positioned eccentrically of the base 7. In FIG. 3, the axis of the base 7 is indicated at 9 whilst that of the bore in the boss 8 is shown at 10. Extending round about one half of the periphery of the base 7 is an upstanding wall 11 in which rectangular recesses 12 are formed at diametrically opposed locations. Circular recesses 13 formed in the eccentric provide "balance" as will be described below.

The bore in the boss 8 is a through-bore 14 (FIG. 5) contoured to provide a 'domed' portion 15 as the bore approaches a recess 16 in the upper (as viewed in FIG. 5) face of the boss. The recess 16 is formed by a peripheral wall 17 and is apertured centrally to communicate with the bore 14. Towards its lower (as viewed in FIG. 5) end, the bore 14 enlarges gradually as indicated at 18.

The bore 14 accommodates a support member 19 whose upper (as viewed in FIG. 5) end is contoured to match that of the domed portion 15 of the bore 14. The member 19 is otherwise cylindrical and has an axial passageway 20.

The passageway 20 is sized to receive a tubular guide 21 (FIG. 4) flanged at one end as at 22, the flange having a radial screw-threaded hole 23 for a grub screw (not shown). The axial length of the guide 21 slightly exceeds that of the bore 14.

Figure 5:
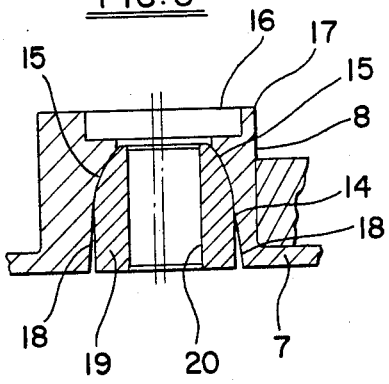
FIG. 5 is a fragmentary view of part of the component of FIG. 2, partly in section to show another component of the first embodiment.

To assemble the components, the support member 19 is first located in the bore 14 as indicated in FIG. 5. The guide 21 is then inserted into the passageway 20 from below (as seen in FIG. 5) until the flange 22 abuts the lower end of the member 19. The guide 21 is then secured in position by a circlip or spring washer placed over that end of the guide that projects slightly into the recess 16.

Figure 1:
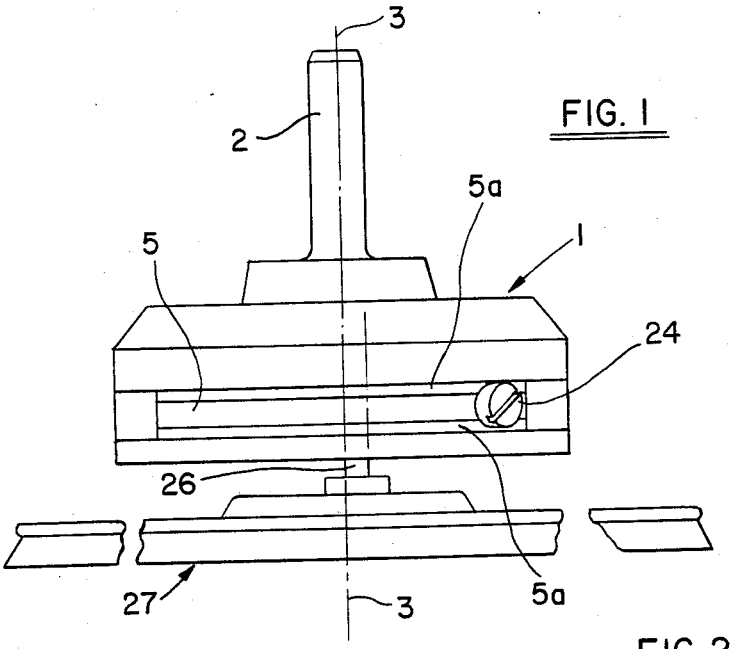
FIG. 1 is a side elevation of a first embodiment.
Figure 2:
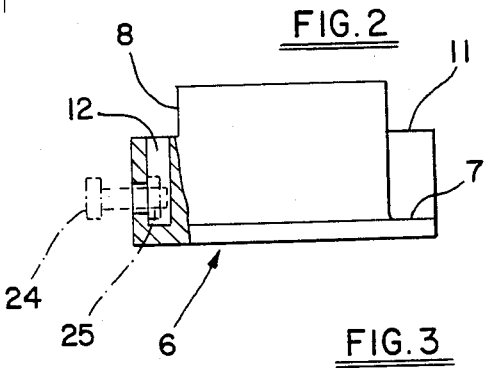
FIG. 2 is a side elevation partly in section of a component of the first embodiment.
Figure 4:
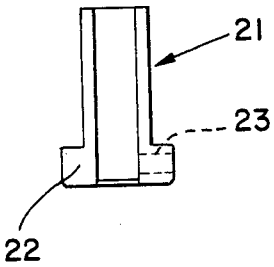
FIG. 4 is a side elevation of another component.

A nut 25 (indicated in FIG. 2) is placed in a recess 12 of the eccentric 6 and the latter is then placed into the circular recess 4 in the body portion 1 and secured in place by a screw 24 inserted through the slot 5 (as indicated in FIG. 1), and into the recess 12 through a hole in the wall thereof where it screws into the nut 25. The head of the screw 24 seats on the step 5*a*. The eccentric 6 is thus held in the recess 4 but can be rotated relatively thereto with limits determined by the length of the slot 5 after loosening the screw 24. In this way, the degree of eccentricity of the axis 9 relative to the axis 3 is continuously variable between the limits determined by the length of the slot 5.

To carry out a surface treatment, the spindle 2 of the assembled attachment is inserted into the chuck 50 of a hand-held power drill 51 (shown in FIG. 9) and the chuck is then tightened. The spindle 26 of a sanding disc 27 is then inserted into the bore of the guide 21 and the grub screw in hole 23 is tightened to grip the spindle 26 tightly. The drill 51 is then switched on and the surface of the disc 27 is applied to the surface to be treated.

The orbital motion imparted to the sanding disc enables the user effectively to carry out the surface treatment.

The user is able to select the degree of eccentricity of the sanding disc 27 and thus the severity of the treatment applied to the surface. At maximum eccentricity, the removal of material from the surface tends to be greatest, whilst at smaller eccentricities the removal is much less or zero giving a finer finish.

The recesses 13 in the eccentric 6 compensate for the eccentricity of the spindle 26 relative to the chuck 50 of the drill and act to retain the balance of the drill regardless of the degree of adjustment of the eccentric 6.

It is possible to set the degree of eccentricity to zero, if required.

It is possible for the sanding disc 27 to tilt slightly and thereby to compensate for a small degree of "out of square" between the spindle 2 and the surface of the sanding disc. Accommodation of the "tilt" is provided by the domed surfaces and the clearance provided by the enlargement 18 of the bore 14.

The ability to vary the degree of eccentricity can also be used to compensate for different sizes of sanding disc and for sanding discs of different masses.

It will be appreciated that the sanding head 27 may be replaced by a buffing or polishing head to achieve other forms of surface finish.

The ability to vary the degree of eccentricity of the treatment head 27, together with the ability to tilt the treatment head slightly and the balancing effect of the recesses 13, 13*a* enable a consistent level of improved performance to be achieved under a variety of conditions.

It will be appreciated that variation of the degree of eccentricity may be obtained in other ways than that just described with reference to FIGS. 1–5.

An example of an alternative arrangement will now be described with reference to FIGS. 6, 7 and 8.

The second embodiment has a hollow cylindrical body portion 28 with an integral spindle 29 lying on the longitudinal axis 30 of the cylinder. For use, the spindle 2 is inserted into the chuck 50 of a power drill 51, in a similar manner to the spindle 2 of FIG. 1 and as illustrated in FIG. 9.

The body portion 28 is configured to provide an internal circular recess 31 that is eccentric with respect to the axis 30 of the body portion 28. The longitudinal axis of the recess 31 is indicated at 33.

The body portion 28 has two recesses 35 in its upper (as viewed in FIG. 6) face, arranged in diametrically-opposed positions adjacent the edge of that face.

Figure 6:
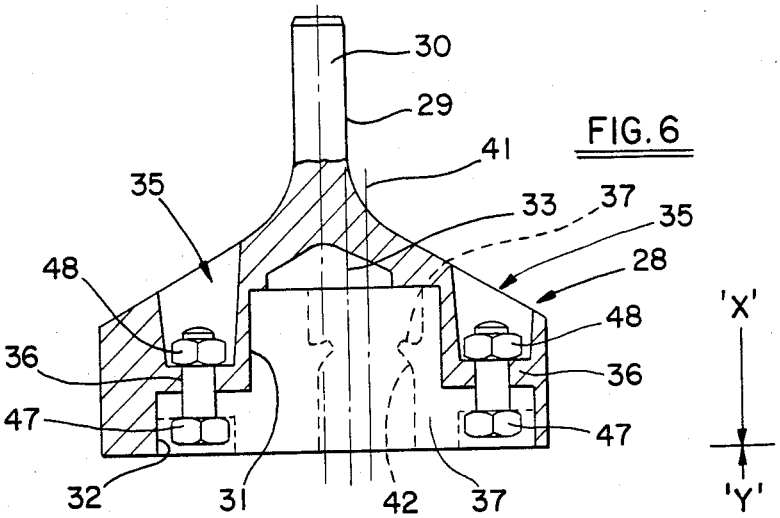
FIG. 6 is a side elevation of a second embodiment.
Figure 7:
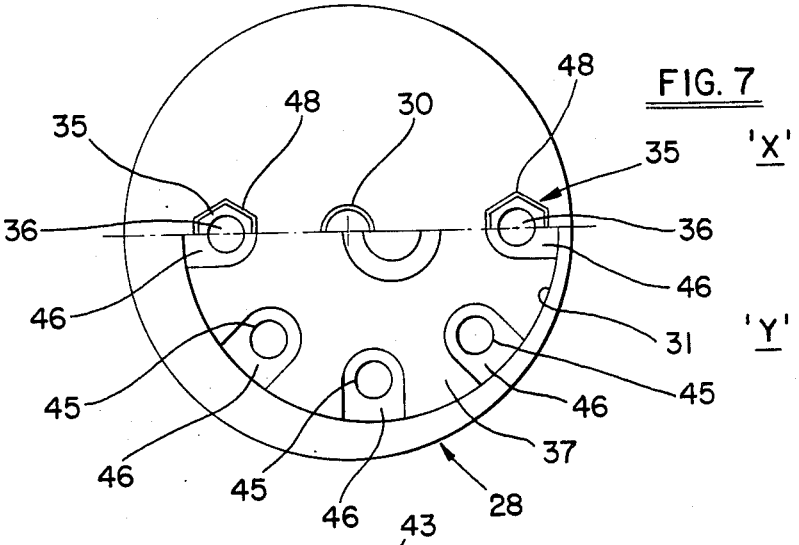
FIG. 7 is combined plan and underneath view of the second embodiment.

FIG. 7, the upper part of which is a view of the body portion looking in the direction of arrow X of FIG. 6, shows the recesses 35 which, as can be seen, are of hexagonal section. Passages 36 extend from the floor of those recesses 35 through to an enlarged mouth portion 32 of the internal recess 31.

The recess 31 is stepped internally to provide the enlarged mouth portion 32 and receives in close contact an eccentric 37 that corresponds in function with eccentric 6 described above.

Figure 8:
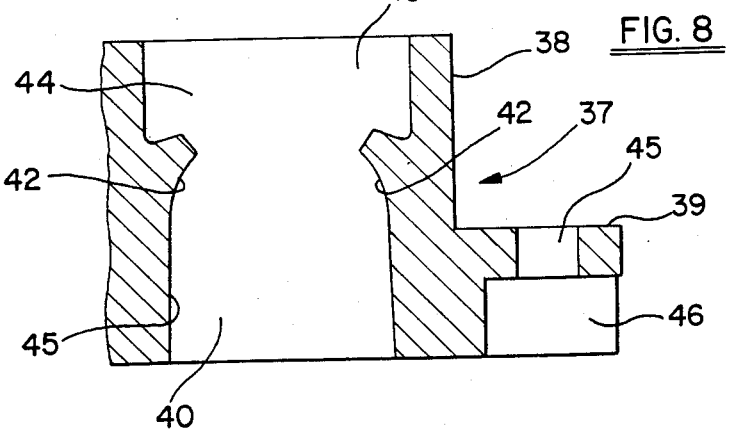
FIG. 8 is a fragmentary section on an enlarged scale of part of a component of the second embodiment.

Eccentric 37, part of which is shown in FIG. 8 on an enlarged scale, has a cylindrical portion 38 that extends upwardly from a base portion 39 of disc shape.

Portion 38 has a longitudinal bore 40 whose axis 41 is slightly offset from the axis 33 as can be seen from FIG. 6. The bore 40 has a domed part 42 and communicates with a recess 43 in the upper (as seen in FIG. 8) end of the portion 38 via a passage 44. The lower (as seen in FIG. 8) part of the bore 40 diverges outwardly slightly as at 45 in a manner similar to that described above with reference to bore 14.

The disc-shaped base portion 39 has a series of spaced holes 45 adjacent its periphery. Each hole 45 communicates with recesses 46 in the lower (as seen in FIG. 8) face of portion 39. Some of the recesses 46 can be seen in FIG. 7, the lower half of which is a view in the direction of arrow Y in FIG. 6. The bore 40 accommodates a support member (not shown) which is similar to member 19 of FIG. 5 and which also houses a guide (not shown) similar to guide 21 of FIG. 4.

In the embodiment shown in FIGS. 6–8, the eccentric 37 is secured in the recess 31 in the body portion 35 by bolts 47 (shown in 'ghost' form in FIG. 6) whose heads locate in a diametrically-opposed pair of the recesses 46 and which screw into nuts 48 (also shown in 'ghost' in FIG. 6) in the recesses 35.

To vary the eccentricity of the eccentric 37, the bolts 47 are unscrewed and removed, and the eccentric 37 is then rotated in the recess 31 to a new position giving the desired eccentricity. The bolts 47 are then replaced.

What is claimed is:

1. A surface treatment attachment for a power tool, comprising:

a body securable to the power tool for rotation thereby and arranged to receive a treatment head;

means for selecting the degree of eccentricity of the treatment head relative to the axis of rotation of the body;

the body comprising a body portion which is securable to the power tool and an eccentric which is rotatable with the body portion and is arranged to receive the treatment head;

the eccentric being adjustably rotatable relative to the body portion to select the degree of eccentricity of the treatment head;

the rotational position of the eccentric relative to the body portion being continuously adjustable within pre-set limits, the attachment including means for securing the eccentric in the selected position; and the rotational position of the eccentric being defined by the position of an aperture in the eccentric relative to a circumferentially-extending slot in the body portion, the securing means extending through the slot and the aperture.

2. An attachment as claimed in claim 1, in which the eccentric is mounted in a recess in the body portion.

3. An attachment as claimed in claim 2, in which the recess is generaly cylindrical, the axis of the cylinder being offset from the axis of rotation of the body portion.

4. An attachment as claimed in claim 3, in which the body portion is generally cylindrical and rotatable about its longitudinal axis.

5. An attachment as claimed in claim 3, in which the eccentric is arranged to receive the treatment head at a location offset from the axis of the cylindrical recess.

6. An attachment as claimed in claim 1, in which the body includes means for accommodating a tilting movement of the head.

7. An attachment as claimed in claim 6, in which a treatment head is mounted in a support member which is located in a bore in the body, the bore and the support member being shaped to permit relative movement therebetween to accommodate tilting movement of the head.

8. An attachment as claimed in claim 1, in which the eccentric has a bore for receiving a spindle of a treatment head.

9. A surface treatment attachment for a power tool, comprising:

a body having a spindle securable to the power tool for rotation thereby about a rotational axis;

said body having an internal circular recess therein, said recess having a central axis eccentric to said rotational axis;

said body having a curved wall around said recess with a slot through said wall and extending arcuately around a portion of said wall;

an eccentric rotatably engaged in said circular recess;

a cavity in said body and containing a nut;

a screw, accessible externally of said body, extending inwardly through said slot into said cavity and threadedly engaging in said nut, loosening of said screw allowing said eccentric to be rotatably adjusted in said recess within arcuate limits created by ends of said slot, and tightening of said screw locking said eccentric against rotation in said recess in an adjusted position; and said eccentric having a bore therein for receiving a spindle of a treatment head, said bore having a central axis eccentric to said central axis of said recess;

whereby eccentricity of said treatment head relative to said rotational axis is continuously adjustable within pre-set limits determined by said arcuate limits.

10. The surface treatment attachment of claim 9, wherein said slot extends arcuately through an arc of 180 degrees.

11. The surface treatment attachment of claim 9, further comprising a cylindrical support member having a central passageway for receiving the spindle of the head, said support member being disposed in said bore, an end of said support member being contoured to match and engage a domed portion of said bore, and said bore enlarging towards an opposite end thereof to provide a clearance between said opposite end and said support member, whereby said treatment head can tilt relative to said central axis of said bore.

12. A surface treatment attachment for a power tool, comprising:

a hollow body having a cylindrical external form with a spindle extending from an upper end of the body for attachment to and rotation by the power tool about a rotational axis;

said body having a downwardly extending peripheral wall defining a circular recess in said body eccentric with respect to said rotational axis;

a slot extending arcuately between two ends thereof around a portion of said wall through an arc of 180 degrees;

an eccentric rotatably mounted in said recess for rotation therein about a second axis eccentric with respect to said rotational axis;

a cavity in said eccentric communicating with said slot through a hole in a side of said eccentric;

a nut in said cavity engaged by a screw extending through said slot and said hole for locking said eccentric in selected rotational positions relative to said body;

said eccentric having a bore therein with a central axis eccentric with respect to said second axis, said bore having a domed upper portion and enlarging downwardly away from said domed portion;

a cylindrical support member disposed in said bore and having an upper end shaped to conform to said domed portion, said support member having a passageway therein generally coaxial with the axis of said bore, but said domed portion and enlarging of said bore allowing tilting of said support member in said bore; and a guide located in said passageway and having a flange adjacent a lower end of said support member, a screw being engaged transversely in said flange for securing a shaft of a treatment head in said passageway;

whereby the degree of eccentricity of said passageway with respect to said rotational axis is adjustable within pre-set limits determined by the ends of said slot, and said treatment head is tiltable relative to said rotational axis.

* * * * *